US012516868B2

(12) United States Patent
Wantland

(10) Patent No.: US 12,516,868 B2
(45) Date of Patent: Jan. 6, 2026

(54) DUAL ROTATION HINGE PASS THROUGH FOR WIRE HARNESS

(71) Applicant: Haier US Appliance Solutions, Inc., Wilmington, DE (US)

(72) Inventor: Louis A. Wantland, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 89 days.

(21) Appl. No.: 18/356,046

(22) Filed: Jul. 20, 2023

(65) Prior Publication Data

US 2025/0027350 A1 Jan. 23, 2025

(51) Int. Cl.
*F25D 23/02* (2006.01)

(52) U.S. Cl.
CPC ..... *F25D 23/028* (2013.01); *F25D 2323/023* (2013.01); *F25D 2323/024* (2013.01); *F25D 2400/40* (2013.01)

(58) Field of Classification Search
CPC ..... F25D 23/028; F25D 2323/02; F25D 2323/023; F25D 2323/024; F25D 2400/40
See application file for complete search history.

(56) References Cited

U.S. PATENT DOCUMENTS

| | | | | |
|---|---|---|---|---|
| 2,150,064 | A | 3/1939 | Robert et al. | |
| 8,388,078 | B2 | 3/2013 | Kwon et al. | |
| 8,544,973 | B2 | 10/2013 | Kwon et al. | |
| 9,170,045 | B2 | 10/2015 | Oh et al. | |
| 9,175,901 | B2 | 11/2015 | Oh et al. | |
| 9,568,238 | B2 * | 2/2017 | Kim | F25D 23/028 |
| RE48,733 | E | 9/2021 | Oh et al. | |
| 11,578,519 | B2 | 2/2023 | Park et al. | |
| 2018/0202706 | A1 * | 7/2018 | Lee | F25D 29/005 |
| 2023/0125013 | A1 * | 4/2023 | Son | F25D 23/063 312/404 |
| 2025/0102217 | A1 * | 3/2025 | Wantland | F25D 23/028 |
| 2025/0116140 | A1 * | 4/2025 | Wantland | F25D 23/025 |

FOREIGN PATENT DOCUMENTS

| | | | |
|---|---|---|---|
| CN | 105546911 A | * | 5/2016 |
| CN | 213898574 U | | 8/2021 |
| CN | 113819697 A | * | 12/2021 |
| CN | 113482472 B | | 1/2023 |
| CN | 218495577 U | | 2/2023 |
| JP | 2001272162 A | * | 10/2001 |

* cited by examiner

*Primary Examiner* — Andrew Roersma
(74) *Attorney, Agent, or Firm* — Dority & Manning, P.A.

(57) ABSTRACT

A hinge assembly for a door-in-door refrigerator appliance door includes a case-side plate having a first aperture at the first end and a first radial slot extending from a periphery of the first aperture to an edge of the plate. A pivot pin having a central passage and a radial slot from the central passage to an edge of the plate is aligned with the first aperture. The hinge assembly also has a door-side plate having a second aperture at the first end and a third radial slot extending from a periphery of the second aperture to an edge of the plate. The second aperture receives the pivot pin for rotation, wherein the first radial slot and the third radial slot are rotationally offset when the case-side plate transverse axis and the door-side plate transverse axis are parallel.

16 Claims, 6 Drawing Sheets

DUAL ROTATION HINGE PASS THROUGH FOR WIRE HARNESS

FIELD OF THE INVENTION

The subject matter of the present disclosure relates generally to refrigerator appliances. In particular, the present subject matter relates hinge assemblies providing a wire harness pass through.

BACKGROUND OF THE INVENTION

Refrigerator appliances generally include a cabinet that defines a refrigerated chamber, for example for food storage. In addition, refrigerator appliances also generally include a door rotatably hinged to the cabinet to permit selective access to food items stored in refrigerated chamber. Certain refrigerator appliances, commonly referred to as door-in-door refrigerator appliances, may include a door frame forming a food storage chamber positioned within the door and selectively accessible through an outer door rotatably hinged to the door frame. Alternatively, the outer door may be securely latched to the frame in the closed position and the frame and door may be rotated together to provide access to the refrigerated chamber.

It is often desirable to provide electrical power or communication to the door assembly of a door-in-door refrigerator appliance by routing one or more wires through a central passage in the door hinge. To facilitate assembly, in some cases a slot is provided in each of the hinge plates to accept the routed wires into the central passage. However, if the slots become aligned, the wires may become displaced from the central passage and may be subject to a cutting or shearing action as the hinge plates rotate during opening and closing of the door.

Accordingly, a door-in-door refrigerator appliance having a hinge assembly with features for routing wires to the door that addresses the technical difficulty described would be useful.

BRIEF DESCRIPTION OF THE INVENTION

Aspects and advantages of the invention will be set forth in part in the following description, may be apparent from the description, or may be learned through practice of the invention.

In one exemplary aspect, a refrigerator appliance defining a vertical direction, a lateral direction, and a transverse direction is disclosed, the vertical, lateral, and transverse directions being mutually perpendicular. The refrigerator appliance comprises a cabinet defining a refrigerated chamber, a front portion of the refrigerated chamber defining an opening for receipt of food items, and a door-in-door assembly mounted at the front portion of the refrigerated chamber and being rotatable between a closed position and an open position to permit selective access to the refrigerated chamber. The door-in-door assembly comprises a door frame forming an inner door including a food storage area located in the inner door, the door frame defining a rotation bore, an outer door rotatably mounted to the door frame to provide selective access to the food storage area, and a hinge assembly. The hinge assembly comprises a case-side plate defining a transverse axis, the case-side plate comprising a first end defining a first aperture through a thickness of the case-side plate and a first radial slot extending from a periphery of the first aperture to an edge of the case-side plate, and a second end coupled to the cabinet. The hinge assembly further comprises a door-side plate defining a transverse axis, the door-side plate comprising a first end defining a second aperture through a thickness of the door-side plate and a second radial slot extending from a periphery of the second aperture to an edge of the door-side plate, and a second end coupled to the outer door. The hinge assembly further comprises a pivot pin extending through the first aperture and the second aperture into the rotation bore to rotatably join the case-side plate and the door-side plate to the door frame, the pivot pin comprising a wall defining a central passage and defining a third radial slot formed through the wall, the third radial slot aligned with the first radial slot.

In another exemplary aspect, a hinge assembly for a door-in-door refrigerator appliance door is provided. The hinge assembly comprises a case-side plate defining a thickness and a transverse axis, a first end of the case-side plate further defining a first aperture through the thickness, and a first radial slot extending from a periphery of the first aperture to an edge of the plate. A pivot pin is aligned with the first aperture and extends perpendicular to the plate, the pivot pin comprising a wall defining a central passage, and including a second radial slot formed through the wall, the second radial slot aligned with the first radial slot. The hinge assembly further comprises a door-side plate defining a thickness and a transverse axis, a first end of the door-side plate defines a second aperture through the thickness and a third radial slot extending from a periphery of the second aperture to an edge of the plate, the second aperture configured to receive the pivot pin for rotation, wherein the first radial slot and the third radial slot are rotationally offset when the case-side plate transverse axis and the door-side plate transverse axis are parallel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
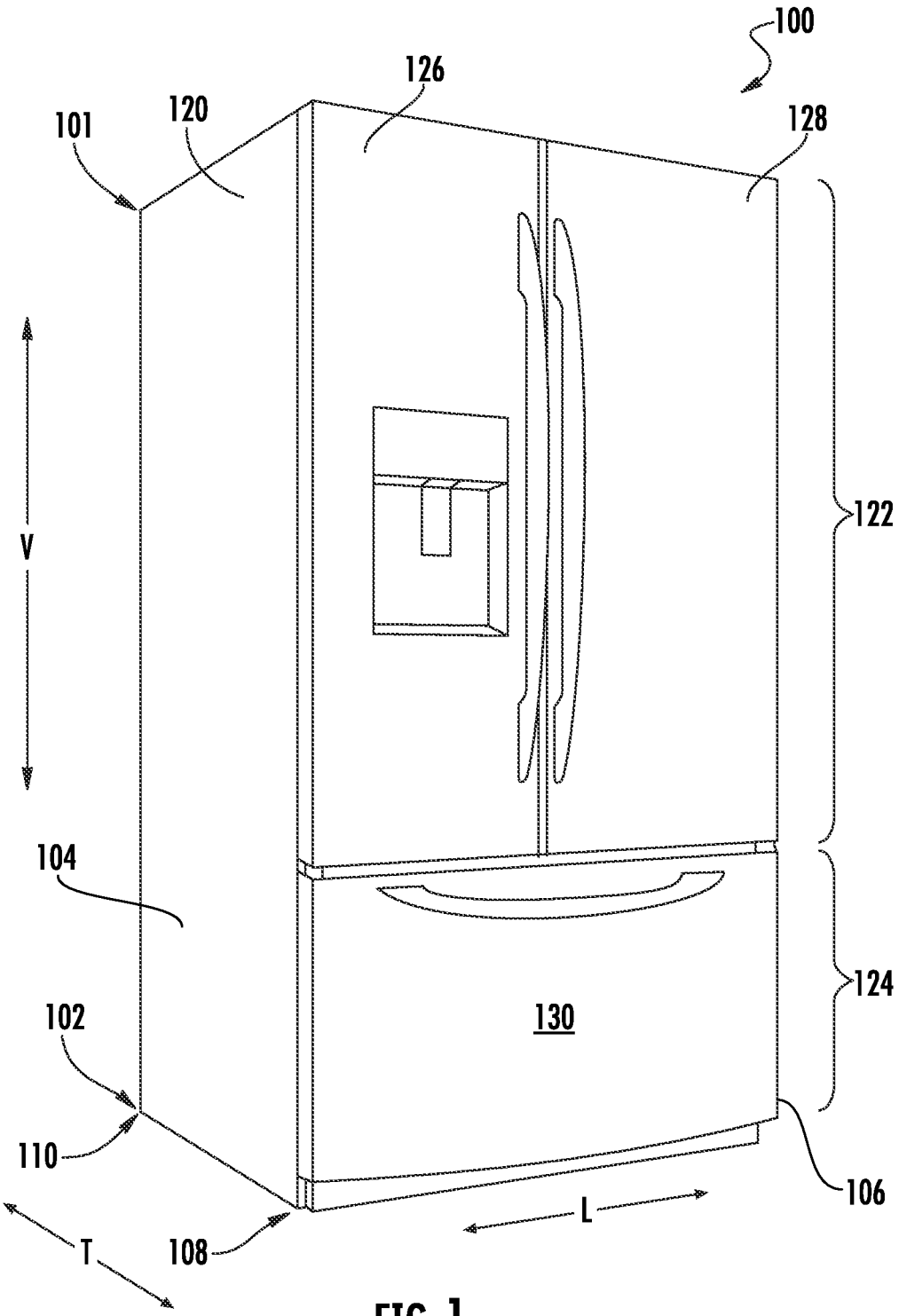
FIG. 1 provides a perspective view of a refrigerator appliance according to exemplary embodiments of the present disclosure with refrigerator doors and a freezer door shown in a closed position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Direction of rotation, either clockwise or counter-clockwise, as used herein is taken from a position above the axis of interest unless clearly indicated otherwise. In the present disclosure, clockwise rotation or counter-clockwise rotation about a vertical axis is from a reference above the axis looking down the axis. In particular, clockwise or counter-clockwise rotation of a hinged door is taken looking along the axis of rotation from a position vertically above the door.

As used in this disclosure, the word "refrigerate," and forms thereof, is used to mean "to make cold or frozen" or "to chill or freeze" as the word is generally accepted and understood. Accordingly, a refrigerated chamber may be a chilled chamber, such as a fresh food storage chamber, or a frozen chamber, such as a frozen food storage chamber.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
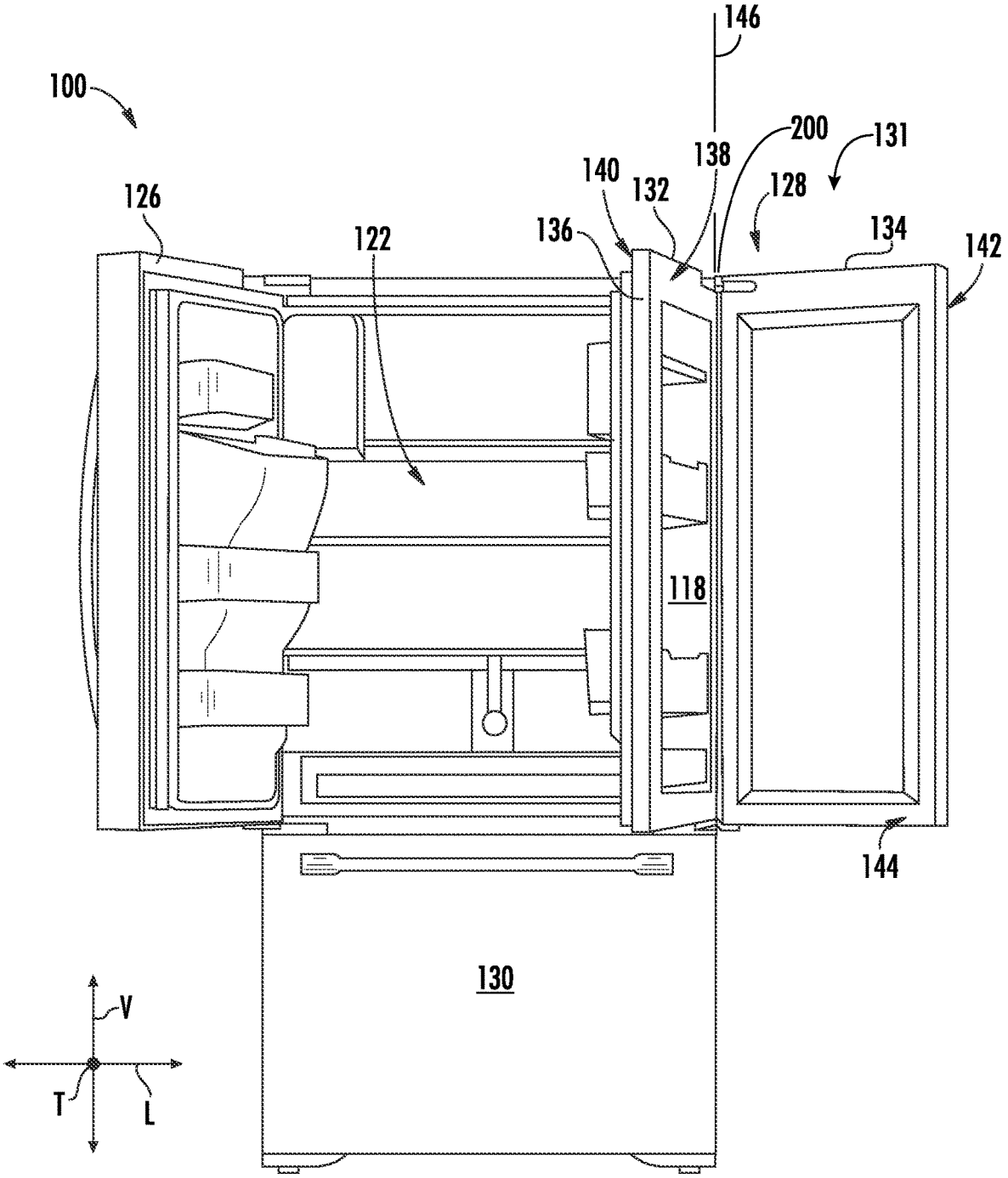
FIG. 2 provides a front elevation view of the refrigerator appliance of FIG. 1 with refrigerator doors shown in an open position.

FIG. 1 provides a perspective view of a refrigerator appliance 100 according to exemplary embodiments of the present subject matter. FIG. 2 provides a front elevation view thereof with refrigerated chamber doors shown in an open position. As shown in FIG. 1, refrigerator appliance 100 includes a cabinet 120 that extends between a top 101 and a bottom 102 along a vertical direction V. Cabinet 120 also extends between a first side 104 and a second side 106 along a lateral direction L and between a front 108 and a rear 110 along a transverse direction T. Vertical direction V, lateral direction L. and transverse direction T are mutually perpendicular and form an orthogonal direction system.

Cabinet 120 defines chilled chambers for receipt of food items for storage. In particular, cabinet 120 defines a refrigerated chamber 122 positioned at or adjacent top 101 of cabinet 120 and a freezer chamber 124 arranged at or adjacent bottom 102 of cabinet 120. As such, refrigerator appliance 100 is generally referred to as a bottom mount refrigerator. It is recognized, however, that the benefits of the present disclosure matter apply to other types and styles of refrigerator appliances, such as e.g., top mount refrigerator appliances, side-by-side style refrigerator appliances, and wine storage refrigerators. Moreover, the benefits of the present disclosure matter may likewise apply to freezer appliances, e.g., upright freezers. In addition, the teachings of the present disclosure may also apply to other types of appliances, including e.g., microwaves, dryers, washing machines, etc. Consequently, the description set forth herein is for exemplary purposes only and is not intended to be limiting in any aspect to any particular type of consumer appliance.

For this embodiment, refrigerator doors, hereinafter doors 126, 128, are configured in a French door configuration and are rotatably hinged or mounted to an edge of cabinet 120 for selectively accessing refrigerated chamber 122. Door 126 (i.e., left door) is rotatably mounted or hinged to cabinet 120 at first side 104 of cabinet 120. Door 128 (i.e., right door) is rotatably mounted or hinged to cabinet 120 at second side 106 of cabinet 120. More specifically, door 128 is rotatably mounted to cabinet 120 via hinge assembly 200. In FIG. 1, doors 126, 128 are shown in a closed position. In FIG. 2, doors 126, 128 are shown in an open position.

As shown in FIG. 2, door 128 comprises a door-in-door assembly 131. As such, door 128 includes inner door 132 and an outer door 134, both of which are shown in an open position in FIG. 2. In other embodiments, door 126 can likewise have a door-in-door configuration. In this way, one or both of doors 126, 128 can have door-in-door configurations. In general, a door-in-door type refrigerator appliance door provides an outer door enclosing a door compartment within a door frame, the outer door providing controlled access to the door compartment. The door-in-door type door also provides a door assembly, including the outer door and the door frame, that provides controlled access to a refrigerated compartment within the cabinet. As illustrated and discussed in the present disclosure, the right-side door, door 128, for refrigerated chamber 122 is used to illustrate features of the present disclosure. This is for convenience only as one of ordinary skill in the art will recognize that the disclosed features can be applied to other door locations, such as door 126 or a freezer chamber door 130. Accordingly, illustrations and discussions of the right-side door-in-door arrangement are for illustration only and not intended to be limiting.

Inner door 132 includes a door frame 136 that has an outer surface 138 and an opposing inner surface 140 that faces toward refrigerated chamber 122 when inner door 132 is in a closed position. Inner door 132 is rotatably hinged to cabinet 120, e.g., such that inner door 132 is movable between a closed position (FIG. 1) and an open position (FIG. 2) to permit selective access to refrigerated chamber 122. In particular, inner door 132 can be rotatably coupled or mounted directly to cabinet 120 at the second side 105 of cabinet 120 via hinge assembly 200. Inner door 132 defines an opening extending through the outer and inner surfaces 138, 140 of frame 136 and into refrigerated chamber 122. Frame 136 extends around a perimeter of the opening defined by inner door 132 and forms a food storage area 118 located in the door-in-door assembly 131. Frame 136 can extend into the refrigerated chamber 122 when inner door 132 is in the closed position.

Outer door 134 includes an outer surface 142 and an opposing inner surface 144. The outer surface 142 faces an exterior of refrigerator appliance 100 and inner surface 144 faces toward refrigerated chamber 122 or toward the interior of refrigerator appliance 100 when outer door 134 is in the closed position. As shown, outer door 134 is rotatably coupled or hinged to inner door 132 via hinge assembly 200. In particular in the present embodiment, inner door 132 and outer door 134 are both rotatably coupled with hinge assembly 200. In this way, door-in-door refrigerator appliance door assembly 131 (including inner door 132 and outer door 134) is directly rotatably coupled with cabinet 120 of refrigerator appliance 100. Outer door 134 is movable between a closed position (FIG. 1) and an open position (FIG. 2). In some embodiments, outer door 134 is movable to permit selective access to a portion of refrigerated chamber 122 through the opening defined by inner door 132. In some embodiments, outer door 134 permits selective access to a food storage area 118 formed in the door-in-door assembly 131. When in a closed position, a portion of outer door 134 can be received within frame 136 of inner door 132.

Inner and outer doors 132, 134 can generally move in the same direction. Specifically, inner and outer doors 132, 134 can each move away or swing out from refrigerated chamber 122 of refrigerator appliance 100 when moving toward their respective open positions or the fully open position for inner and outer doors 132, 134. Moreover, inner and outer doors 132, 134 can each move toward refrigerated chamber 122 of refrigerator appliance 100 when moving toward their respective closed positions. As illustrated, door assembly 131 (i.e., inner and outer doors 132, 134) rotate about an axis 146 in a clockwise direction (when viewed vertically downward along axis 146) to close the doors 132, 134, and rotate in a counterclockwise direction to open the doors 132, 134.

In some embodiments, refrigerator appliance 100 includes a gasket positioned on inner surface 144 of outer door 134. As outer door 134 moves toward the closed position, outer door 134 can compress the gasket against outer surface 138 of inner door 132. Specifically, the gasket may seal against outer surface 138 of inner door 132 to enclose refrigerated chamber 122. In alternative embodiments, the gasket can be positioned on outer surface 138 of inner door 132, and as outer door 134 moves toward the closed position, inner door 132 can compress the gasket against inner surface 144 of outer door 134. More specifically, the gasket can seal against inner surface 144 of outer door 134. It should be appreciated that the gasket can be formed of any suitable material. For example, in some embodiments, the gasket can be formed of a resilient rubber or plastic material.

As further shown in FIGS. 1 and 2, a freezer door 130 is arranged below doors 126, 128 for selectively accessing freezer chamber 124 (FIG. 1). Although freezer door 130 is configured as a pull out drawer in FIG. 1, in other exemplary embodiments, refrigerator appliance 100 can include one or more freezer doors that are rotatably hinged or mounted to housing 102 in the same or similar fashion as doors 126, 128. In some embodiments, hinged freezer doors may include door-in-door features.

Figure 3:
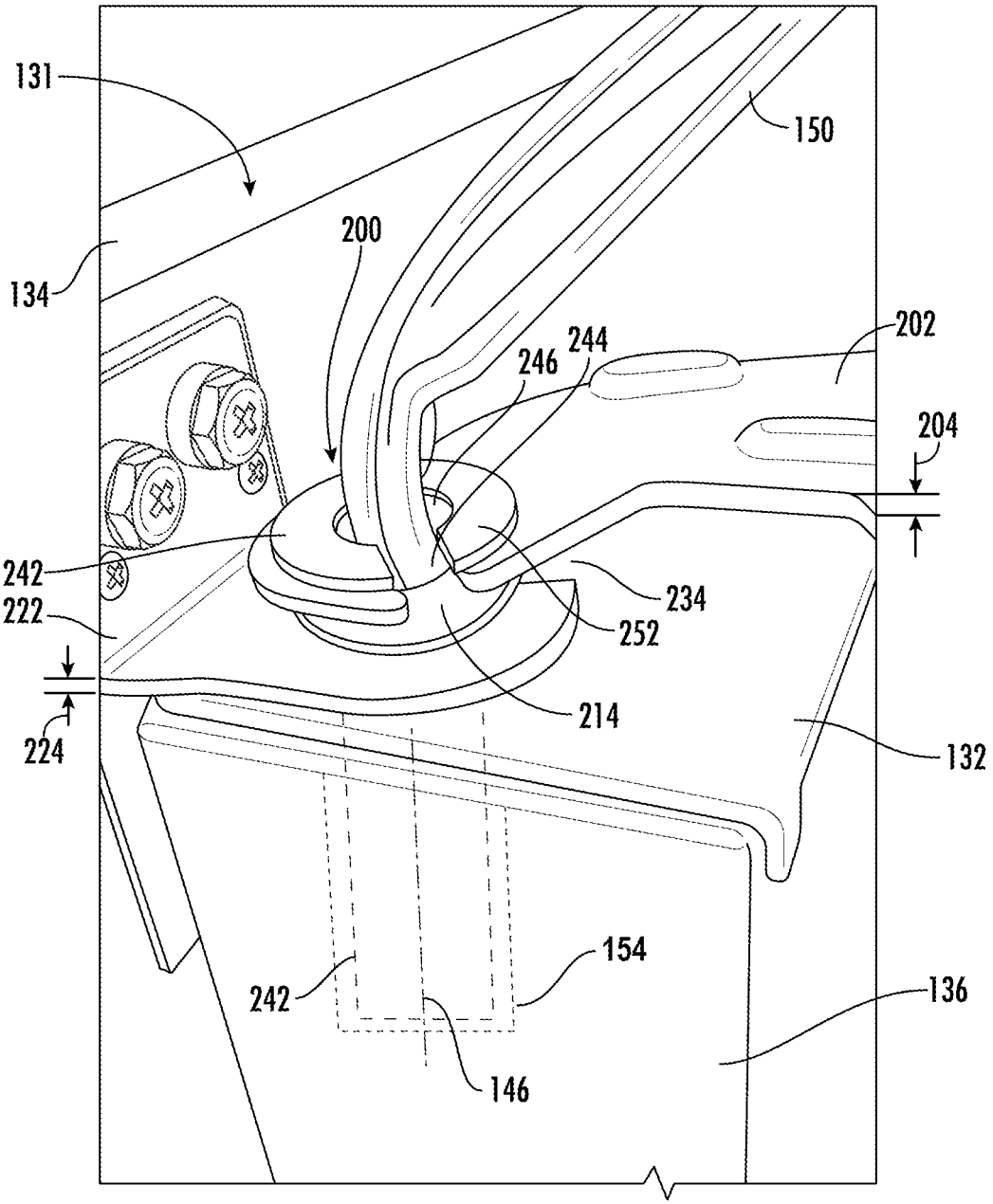
FIG. 3 provides an enlarged view of the hinge assembly in accordance with an embodiment of the present disclosure.

As illustrated in FIG. 3, door assembly 131 comprises inner door 132 and outer door 134 rotatably coupled or joined by hinge assembly 200 comprising case-side plate 202, door-side plate 222, and pivot pin 242. Wire harness 150 passes through a central passage 246 in the pivot pin 242 to provide, for example, electric power and communication to the door-in-door refrigerator appliance door assembly 131.

Figure 4:
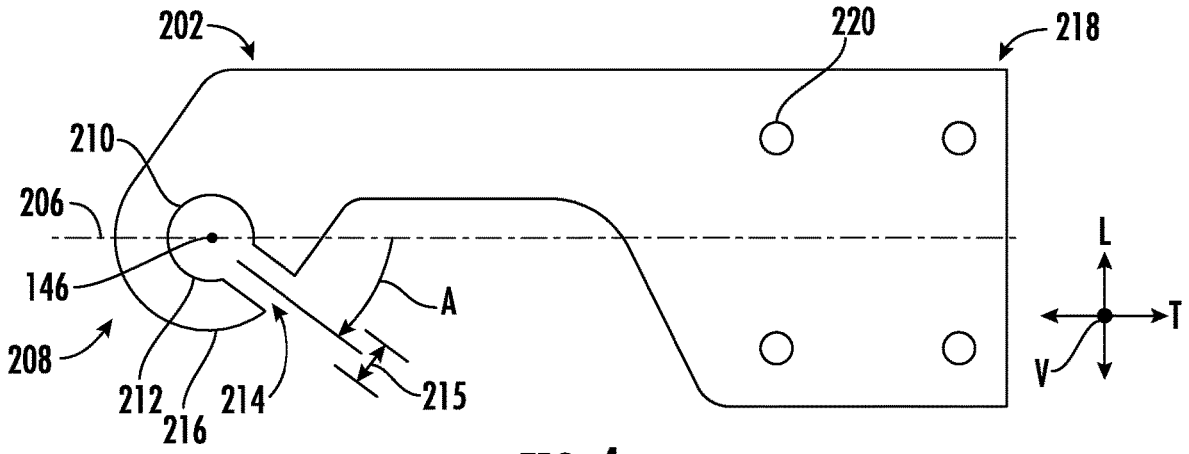
FIG. 4 provides a plan view of a case-side plate in accordance with an embodiment of the present disclosure.

In greater detail with reference to FIG. 4, hinge assembly 200 includes case-side plate 202 having a first end 208 including first aperture 210 formed through the thickness 204 (FIG. 3). The first end 208 defines first aperture 210 having a generally circular periphery 212 centered on transverse axis 206, which may be centrally located on case-side plate 202. Second end 218 may be adapted for fixed coupling to the cabinet 120. For example, mounting holes 220 may be provided to accept fasteners to fixedly couple the case-side plate to the cabinet 120. Generally, any suitable threaded fastener (e.g., screws or bolts), friction fit fasteners, or interference fit fasteners (e.g., rivets), or other fastener types or combinations thereof, may be used to secure the case-side plate 202 to the cabinet 120.

The first end 208 also defines a first radial slot 214 extending from the periphery 212 of the first aperture 210 to the edge 216 of the case-side plate 202. In the illustrative embodiment, first radial slot 214 is angularly positioned from the transverse axis 206 by an angle A in the clockwise direction when viewed downward along axis 146. Generally, angle A may be between 0 degrees and 90 degrees, or between 30 degrees and 60 degrees, or about 45 degrees measured from the transverse axis 206 in a clockwise direction. First radial slot 214 has a slot width 215.

Figure 5:
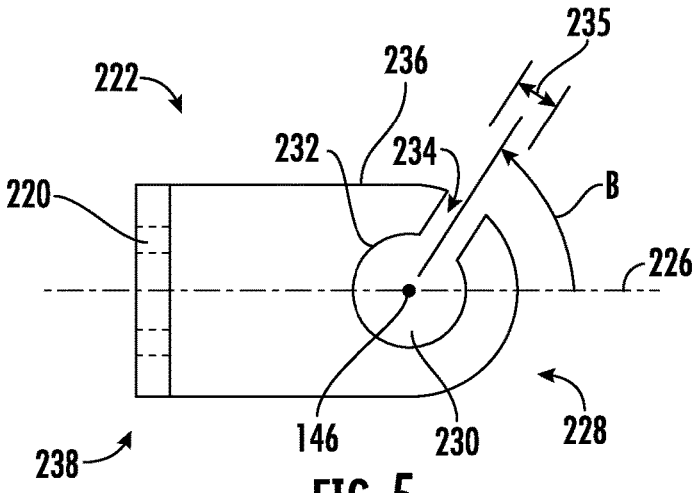
FIG. 5 provides a plan view of a door-side plate in accordance with an embodiment of the present disclosure.

Turning to FIG. 5, door-side plate 222 includes first end 228, second end 238 and transverse axis 226. First end 228 includes second aperture 230 defined by generally circular periphery 232 centered on transverse axis 226 and formed through the thickness 224 (FIG. 3). Third radial slot 234 is defined at the first end of door-side plate 222 and extends from the periphery 232 to the edge 236. In the illustrative embodiment, third slot 234 is angularly positioned from the transverse axis 226 by an angle B in the counter-clockwise direction when viewed downward along axis 146. Generally, angle B may be between 0 degrees and 90 degrees, or between 30 degrees and 60 degrees, or about 45 degrees measured from the transverse axis 206 in a clockwise direction. Third radial slot 234 has a slot width 235, substantially the same as first radial slot width 215. In general terms, the first radial slot 214 may be radially offset from the case-side plate 202 transverse axis 206 by one of a clockwise direction or a counter-clockwise direction and the third radial slot may be radially offset from the door-side plate 222 transverse axis 226 by the other of a clockwise direction or a counter-clockwise direction.

Second end 238 of door-side plate 222 may be configured for fixed coupling to the outer door 134. For example, mounting holes 220 may be provided to accept fasteners to fixedly couple the case-side plate to the outer door 134. Generally, any suitable threaded fastener (e.g., screws or bolts), friction fit fasteners, or interference fit fasteners (e.g., rivets), or other fastener types or combinations thereof, may be used to secure the door-side plate 222 to the outer door 134.

Figure 6:
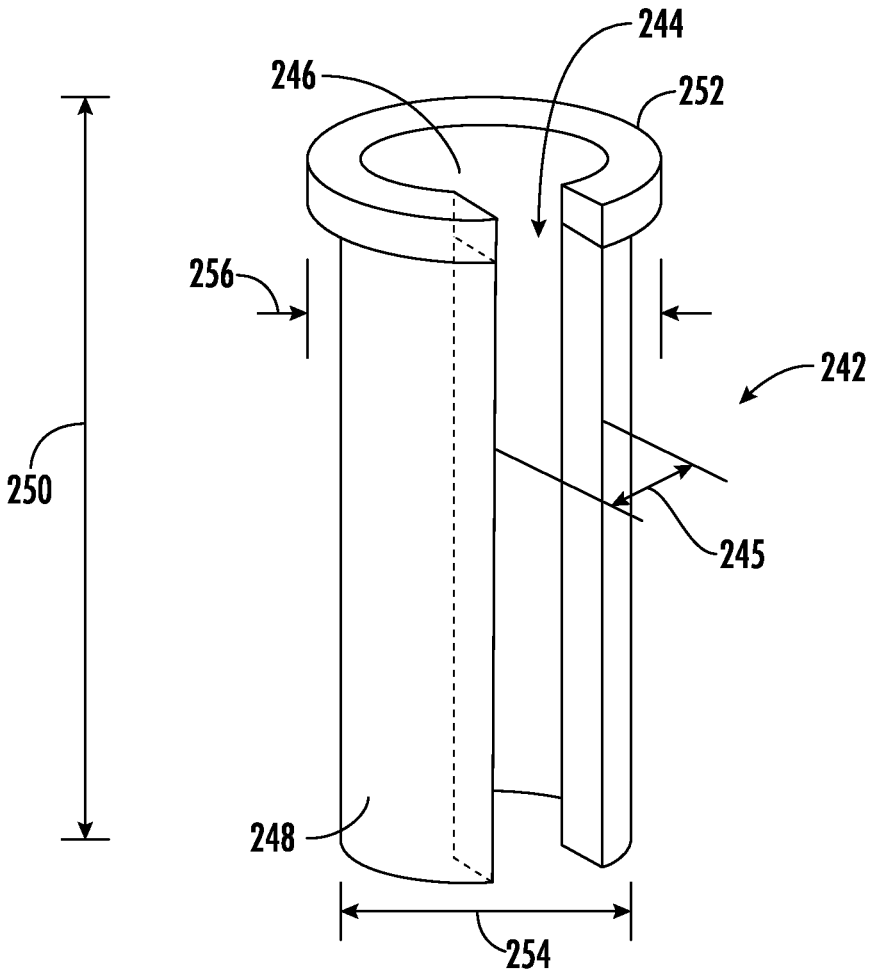
FIG. 6 provides a perspective view of a pivot pin in accordance with an embodiment of the present disclosure.

Turning now to FIG. 6, pivot pin 242 comprises a generally circular wall 248 defining a central passage 246 along the length 250. One end of the pivot pin 242 may have a collar 252 having a diameter 256 larger than the pivot pin diameter 254. A second radial slot 244 is formed through the length of the wall 248 and through the diameter 256 of the collar 252. Generally, the second radial slot 244 has a width 245 substantially the same as the first radial slot 214 and the third radial slot 234.

The pivot pin 242 is accepted in first aperture 210 such that the collar 252 abuts a top surface of the case-side plate 202 and the length 250 extends through the thickness 204, generally perpendicular to the case-side plate 202. The pivot pin may be rotationally fixed to the case-side plate 202 such that the second radial slot 244 is fixedly aligned with the first radial slot 214. Accordingly, the second radial slot 244 is fixed rotationally at the same angular displacement A from the transverse axis 206 as the first radial slot 214.

Figure 7:
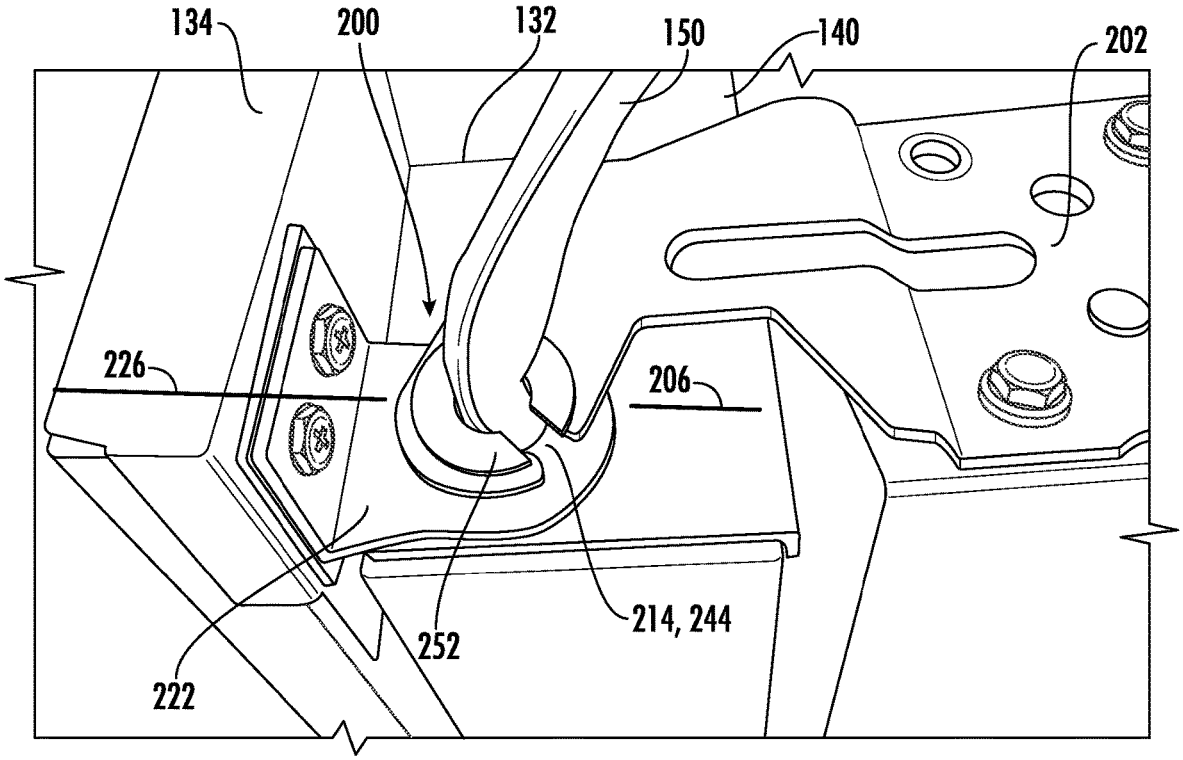
FIG. 7 provides an enlarged view of the hinge assembly in accordance with an embodiment of the present disclosure.

When the hinge assembly 200 is assembled as in FIGS. 3 and 7, pivot pin 242 is accepted in second aperture 230 such that door-side plate 222 may freely rotate about the pivot pin 242. As best illustrated in FIG. 7, when the door-in-door assembly 131 is in the closed position, transverse axes 206, 226 of the case-side plate 202 and the door-side plate 222 are aligned in the V-T plane. As such, the first radial slot 214 and the third radial slot 234 are rotationally offset by a radial displacement generally determined by the measures of angle A plus angle B. In an embodiment, the angular offset between the first radial slot 214 and the third radial slot 234 when the door-in-door assembly is closed is about 90 degrees.

With the hinge assembly 200 mounted to the refrigerator appliance 100, length 250 of pivot pin 242 extends through second aperture 230 and further extends into bore 154 in the door frame 136, pin rotatably joining the outer door 134 to the door frame 136. Thus, the central passage in the pivot pin 242 and the bore 154 cooperate to provide a wire harness chaseway in the door frame 136 to provide electrical power and communication to the door-in-door assembly 131. The pivot pin wall 248 and the door-side plate 222, particularly the periphery 232, cooperate to provide a wire harness 150 chaseway outside the door frame 136.

Further, with the case-side plate 202 fixed to the cabinet 120, door frame 136 (and accordingly door-in-door assembly 131 including the inner door 132 and outer door 134) may rotate about the same axis 146 about the case-side plate 202. In the exemplary embodiment illustrated, the door-in-door assembly 131 is mounted to the right side of the cabinet 120 (i.e., corresponding to door 128 of FIG. 1). As such the inner surface 144 of inner door 132 abuts the cabinet 120 and is blocked from rotation in the clockwise direction as viewed downward along axis 146. From the closed position of FIG. 7, door-in-door assembly 131 may rotate in a counter-clockwise direction to an open position.

Accordingly, third radial slot 234 is rotationally positioned from the transverse axis 226 in the direction of rotation of the door-in-door assembly 131, rotating from the closed position to an open position. Similarly, first radial slot 214 is rotationally offset from the transverse axis 206 in a direction opposite to that of the door-in-door assembly 131 rotating from the closed position to an open position.

According to embodiment of the present disclosure, a rotational stop is provided for the door-in-door assembly 131 in at least the rotational direction from a closed position to an open position (i.e., counterclockwise). The stop is provided such that maximum rotational displacement of the door-side plate 222 (and therefore the door-in-door assembly 131) from the closed position is no more than the rotational displacement between the first and third radial slots when the door-in-door assembly is in the closed position and a full rotation of the door-side plate (and the door-in-door assembly) about the pivot pin 242. In other words, a full rotation about axis 146 is 360 degrees. The first and third radial slots 214, 234 are offset by angle A plus angle B. The rotational stop for the door-side plate (and the door-in-door assembly 131) is positioned at no more than 360 degrees minus (A+B). As a numerical example, if angle A is about 45 degrees and angle B is about 45 degrees, the rotational stop would be located to prevent door-in-door assembly 131 from rotating beyond 360 degrees minus (45 degrees+45 degrees) or about 270 degrees measured in a counter-clockwise direction from the closed position (with transverse axes 206, 226 aligned). The door-side plate 222 has a maximum rotational displacement corresponding to a rotational displacement from the closed position of the door-in-door assembly 131 to a fully open door frame 136 and a fully open outer door 134.

By positioning the stop and limiting rotation of the door-side plate 222 as above, the first and third radial slots 214, 234 are not aligned during rotation of the door-in-door assembly 131. Similarly, a portion of the case-side plate 202 is vertically above the third radial slot throughout the maximum allowed rotational displacement of the door-side plate 222. Accordingly, the wire harness 150 cannot be displaced from the central passage 246. In this way, the central passage 246 and periphery 212 of second aperture 230 cooperate to constrain the wire harness 150.

In coupling the door-in-door assembly 131 to the cabinet 120, the first radial slot 214, the second radial slot 244, and the third radial slot 234 may be aligned to accept a portion of wire harness 150 into the central passage 246 prior to coupling one or both of the second end of the case-side plate 202 to the cabinet 120 and the second end of the door-side plate 222 to the door-in-door assembly 131. Prior to coupling one or both of the plates 202, 222, the plates may be manipulated to align the first, second, and third radial slots 214, 244, 234 to provide a passage for the wire harness 150 into the central passage 246. After the wire harness 150 is within the central passage 246, the case-side plate 202 and the door-side plate 222 may be moved such that radial slots 214, 244, 234 are no longer aligned and the wire harness 150 is captured in the central passage 246.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A refrigerator appliance defining a vertical direction, a lateral direction, and a transverse direction, the vertical, lateral, and transverse directions being mutually perpendicular, the refrigerator appliance comprising:

a cabinet defining a refrigerated chamber, a front portion of the refrigerated chamber defining an opening for receipt of food items; and a door-in-door assembly mounted at the front portion of the refrigerated chamber and being rotatable between a closed position and an open position to permit selective access to the refrigerated chamber, the door-in-door assembly comprising:

a door frame forming an inner door including a food storage area located in the inner door, the door frame defining a rotation bore; and an outer door rotatably mounted to the door frame to provide selective access to the food storage area; and a hinge assembly comprising:

a case-side plate defining a transverse axis, the case-side plate comprising a first end defining a first aperture through a thickness of the case-side plate and a first radial slot extending at a first angle from the transverse axis of the case-side plate from a periphery of the first aperture to an edge of the case-side plate, and a second end coupled to the cabinet;

a door-side plate defining a transverse axis wherein the transverse axis of the door-side plate is approximately aligned with the transverse axis of the case-side plate when the door-in-door assembly is in the closed position, the door-side plate comprising a first end defining a second aperture through a thickness of the door-side plate and a third radial slot extending at a second angle from the transverse axis of the door-side plate from a periphery of the second aperture to an edge of the door-side plate, and a second end coupled to the outer door; and a pivot pin extending through the first aperture and the second aperture into the rotation bore to rotatably join the case-side plate and the door-side plate to the door frame, the pivot pin comprising a wall defining a central passage and defining a second radial slot formed through the wall, the second radial slot aligned with the first radial slot, wherein the first angle is clockwise from the transverse axis of the case-side plate and the second angle is counterclockwise from the transverse axis of the door-side plate, wherein the door-side plate has a maximum rotational displacement corresponding to a rotational displacement from the closed position to a fully open position, wherein the door frame and the outer door are each fully open in the fully open position of the door-in-door assembly, wherein the maximum rotational displacement of the door-side plate is less than a full rotation by at least the sum of the first angle and the second angle, whereby both of the first radial slot and the second radial slot are angularly spaced apart from the third radial slot throughout an entire rotation of the door-in-door assembly from the closed position to the fully open position.

2. The refrigerator appliance of claim 1, wherein the pivot pin is rotationally fixed to the case-side plate.

3. The refrigerator appliance of claim 1, wherein the pivot pin rotatably joins the outer door to the door frame.

4. The refrigerator appliance of claim 1, wherein the first radial slot is angularly positioned from the transverse axis of the case-side plate in a direction of rotation opposite to that of the outer door rotating from the closed position to the open position.

5. The refrigerator appliance of claim 4, wherein the third radial slot is angularly positioned from the transverse axis of the door-side plate in a direction of rotation of the outer door from the closed position to the open position.

6. The refrigerator appliance of claim 1, wherein the first radial slot and the third radial slot are rotationally offset by about 90 degrees when the door-in-door assembly is in the closed position.

7. The refrigerator appliance of claim 1, wherein the pivot pin wall and the door-side plate cooperate to provide a wire harness chaseway outside the door frame.

8. The refrigerator appliance of claim 1, wherein the first radial slot, the second radial slot, and the third radial slot may be aligned to accept a portion of a wire harness in the central passage prior to coupling one or both of the second end of the case-side plate to the cabinet and the second end of the door-side plate to the door-in-door assembly.

9. The refrigerator appliance of claim 1, wherein the central passage in the pivot pin and the bore cooperate to provide a wire harness chaseway in the door frame.

10. The refrigerator appliance of claim 1, wherein the door frame and the outer door rotate about a same axis.

11. The refrigerator appliance of claim 1, wherein a portion of the case-side plate is vertically above the third radial slot throughout the maximum rotational displacement of the door-side plate.

12. A hinge assembly for a door-in-door refrigerator appliance door, the hinge assembly comprising:

a case-side plate defining a thickness and a transverse axis, a first end of the case-side plate further defining a first aperture through the thickness and a first radial slot extending at a first angle from the transverse axis of the case-side plate from a periphery of the first aperture to an edge of the case-side plate;

a pivot pin aligned with the first aperture and extending perpendicular to the plate, the pivot pin comprising a wall defining a central passage, and including a second radial slot formed through the wall, the second radial slot aligned with the first radial slot; and a door-side plate defining a thickness and a transverse axis, a first end of the door-side plate defining a second aperture through the thickness and a third radial slot extending at a second angle from the transverse axis of the door-side plate from a periphery of the second aperture to an edge of the door-side plate, the second aperture configured to receive the pivot pin for rotation;

wherein the first radial slot and the third radial slot are rotationally offset when the case-side plate transverse axis and the door-side plate transverse axis are parallel, and wherein the first angle is clockwise from the transverse axis of the case-side plate and the second angle is counterclockwise from the transverse axis of the door-side plate, wherein the door-side plate has a maximum rotational displacement corresponding to a rotational displacement from a closed position to a fully open position, wherein the maximum rotational displacement of the door-side plate is less than a full rotation by at least the sum of the first angle and the second angle, whereby both of the first radial slot and the second radial slot are angularly spaced apart from the third radial slot throughout an entire rotation from the closed position to the fully open position.

13. The hinge assembly of claim 12, wherein the first radial slot and the third radial slot are offset one from the other by approximately 90 degrees.

14. The hinge assembly of claim 12, wherein the pivot pin is rotationally fixed to the case-side plate.

15. The hinge assembly of claim 12, wherein the pivot pin wall and the door-side plate cooperate to provide a wire harness chaseway in the central passage.

16. The hinge assembly of claim 12, wherein the first radial slot, the second radial slot, and the third radial slot may be aligned to accept a portion of a wire harness in the central passage.

* * * * *